US006216378B1

(12) United States Patent
Roberto

(10) Patent No.: US 6,216,378 B1
(45) Date of Patent: Apr. 17, 2001

(54) PHOTO-FRAME POSTCARD STRUCTURE AND PRODUCT

(75) Inventor: Favero Roberto, Tarzo (IT)

(73) Assignee: STAK ATT SRL., Tarzo (IT)

( * ) Notice: Subject to any disclaimer, the term of this patent is extended or adjusted under 35 U.S.C. 154(b) by 0 days.

(21) Appl. No.: 09/440,536

(22) Filed: Nov. 16, 1999

(30) Foreign Application Priority Data

Nov. 20, 1998 (IT) ..... TV98A0156

(51) Int. Cl.[7] ..... G09F 1/10; A47G 1/06
(52) U.S. Cl. ..... 40/773; 40/124.191
(58) Field of Search ..... 40/124.191, 773

(56) References Cited

U.S. PATENT DOCUMENTS 3,355,828 * 12/1967 Betz ..... 40/773
4,825,574 * 5/1989 Georgia ..... 40/773
4,947,566 * 8/1990 Hoebel ..... 40/773

* cited by examiner

*Primary Examiner*—Cassandra H. Davis
(74) *Attorney, Agent, or Firm*—Edmund M. Jaskiewicz

(57) ABSTRACT

A photo-frame postcard structure and product consisting of two superimposed layers, whereby one side of the structure has an adhesive area for the association of a photographic reproduction thereon and the other side of the structure has pre-printed postcard indicia and a foldable support member for supporting the structure upon a horizontal surface.

4 Claims, 3 Drawing Sheets

PHOTO-FRAME POSTCARD STRUCTURE AND PRODUCT

DESCRIPTION

The present invention has for object an improvement to a photo-frame postcard structure and product so obtained.

The invention, finds particular even if not exclusive application in the field of stationery shops, paper industry and items for the interiors furnishing in general, as an anniversary knick-knack.

BACKGROUND OF THE INVENTION

The postcards are known. They, of all sizes, have some very similar features in common. In fact, they are made up of a stiff board, generally made up of card and having a certain thickness, so that during the shipment it cannot be damaged, with a rectangular shape, and with two completely visible sides. In correspondence of a first side, as known, a more or less typical picture view, sometimes differently matched, of the place where one has been or from where one wants to send his greetings, is shown. In alternative, instead of the usual landscape photo, the postcards are today proposed on the market with different meanings, as wishes, drawings, even tridimensional in some variations. A surely constant feature of every postcard, is instead the back, that is the surface generally subdivided in two areas, in which on a side, the addressee address must be written, on the other one, a suitable often white coloured space being provided, it is possible writing one's own greeting message.

The postcard is undoubtedly advantageous, meaning that on a side it is less expensive than the traditional letter, that is for what concerns the stamps needed in the following phase of mailing, on the other it requires less time in the filling, being limited to the writing of the address and to the greetings with the mailing of a picture to be shared with someone and which recalls the visited place. Nevertheless, it is not always usable, and when it can be used it is very disadvantageous with respect to a letter, because it tends to give the idea of a rather cold and poor relation, mainly in those cases where some special events occur. As a consequence, in most cases, such as birthdays, wishes of different kind, including holidays, which cannot be wished personally, one uses either the traditional letter, or at the most, the cold and impersonal wishes cards. Both in the letter and in the wishes cards, though, is often present the free insertion of photos, together with a book-like folded card, a habit mainly used abroad, whose use though must keep into consideration a certain weight, which when passed, reaches some post rates higher than the usual ones.

Finally, the photo-frame structures are also known. Traditionally, they are made up of a frame, in metal, wood, but also in plastic for the cheapest frames. Behind said frame, a glass for the photo protection together with a card or other support rigid material which is retained perimetrally by suitable hooks which interact with the frame is provided. The card for retaining the photo so to make it visible, is generally provided with a support small foot hinged to the same, which according to the value of the photo-frame may be of different shape and material. Said small foot, perpendicularly book-like opened outwards, allows the supporting in tilted position of the photo-frame. Known in many variations, the frame is widely used as knick-knack and, mainly when it has a value, it may become also a good present.

In case of an anniversary or just as a simple present, between two people living afar, who use the traditional mail for exchanging their greetings, the main drawback, for instance for the addressee when he receives a photo, is looking for a frame which is not always available and which however, involves at least a certain cost. Not only, but it will also be necessary removing the rear supports with respect to the frame and inserting the photo, this latter operation being (mainly for disable people, like old people) very difficult because of the hooking systems which are often complex and not efficient. The sender is so perplex about such a condition that sometimes he does not know whether sending the photo now or doing it another time.

SUMMARY OF THE INVENTION

In the national patent n. 1-279 489 (Armellin et al.), the above mentioned drawbacks, are solved by means of a photo-frame postcard structure and product so obtained, essentially made up of two layers preferably in card, partially pre-jointed in which respectively:

- a first one makes up an adhesive support means of a photographic reproduction of the traditional type eventually provided with a perimetrical square;
- a second one, making up the pre-printed rear according to the postcard usual size, having a diagonally pre-drawn dash-line, so that an end of this might be lifted and opened for becoming the support means of said photo-frame postcard structure.

The just described solution, undoubtedly and advantageously solves the mentioned problems. It, though, creates other problems, which substantially consist of the technical difficulties of embodiment, for which there is a manual strong component, and of the costs relative to them, for obtaining a quality product. Such difficulties, thus, have a negative effect also on the execution times, which might become too long, definitely not allowing a suitable development to the product.

From an even more technical viewpoint, it may be considered that in this solution, we have a matching between two different cards, each of which is semi-finished, which make up the postcard structure, and only one of these thus jointed cards, is provided with an adhesive support for applying on it the photographic reproduction.

Purpose of the present invention, even considering the previous patent from which it derives according to art. 5 l.i, is that of obtaining an improvement to the good compromise, between the usual postcard and the traditional photo-frame, but also that of obviating to some drawbacks.

These and other purposes, are reached with the present invention according to the characteristics as in the enclosed claims, solving the mentioned problems by means of an improved photo-frame postcard structure and product so obtained, essentially consisting of two superimposed layers, preferably made up of card, in which respectively:

- on a side, it makes up an adhesive support means for the association of a photographic reproduction of the traditional type eventually provided with a perimetrical square;
- on the other one, making up the structure rear, pre-printed according to the postcard usual size, giving as a result a diagonally drawn dash-line, so that an edge of the first card, might be lifted and opened for becoming a support means of said photo-frame postcard structure;

and in which, said postcard structure, is obtained by folding and locally gluing one on the other the two halves of a stiff board made up of a pre-jointed sandwich, comprising a bi-adhesive film between two card layers.

In such a way, through the considerable creative contribution whose effect represents an immediate technical progress, some advantages already present and pointed out for the previous solutions, such as for instance the fact that the postcard customising is made possible, by the sending of a single message including the greetings and the desired photographic reproduction, are optimised. On the other hand, it will not force the addressee to look for a photo-frame, it being easily replaced by the inherent structure. Thus, it can at least provide for a better comfort, referred to the simplified use which does not require any intervention on the frame by the addressees.

With regard to this improvement, it allows the speeding up of the postcard structure productive process, and obviously in great amounts, substantially reducing the realisation costs with a clear benefit for the final user.

These and other advantages will appear from the following detailed description of a preferred embodiment solution, with the aid of the enclosed schematic drawings whose execution details are not to be considered as limitations but are only supplied as examples.

Figure 1:
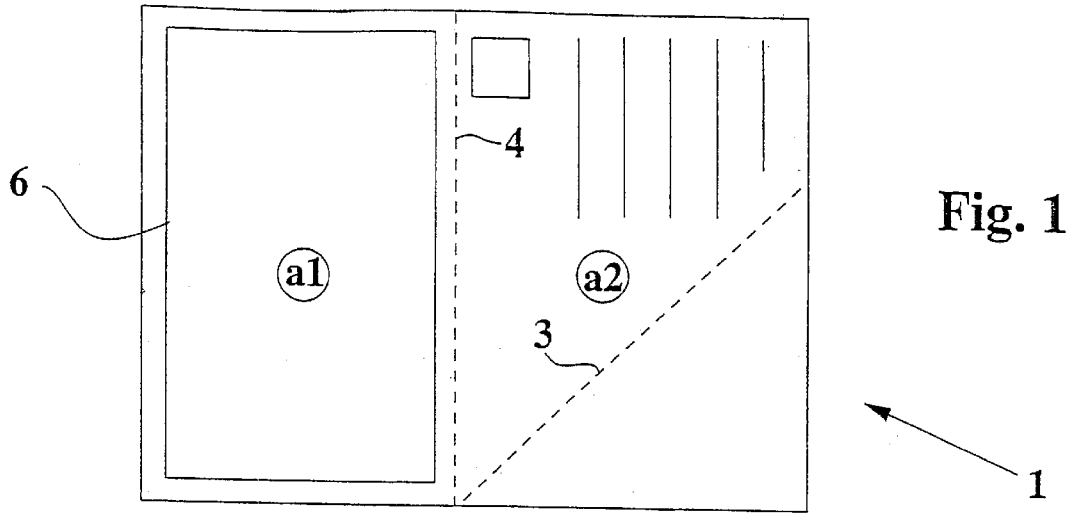
FIG. 1., shows the stiff board support according to a front view, developed on plan and before being folded in half.
Figure 2:
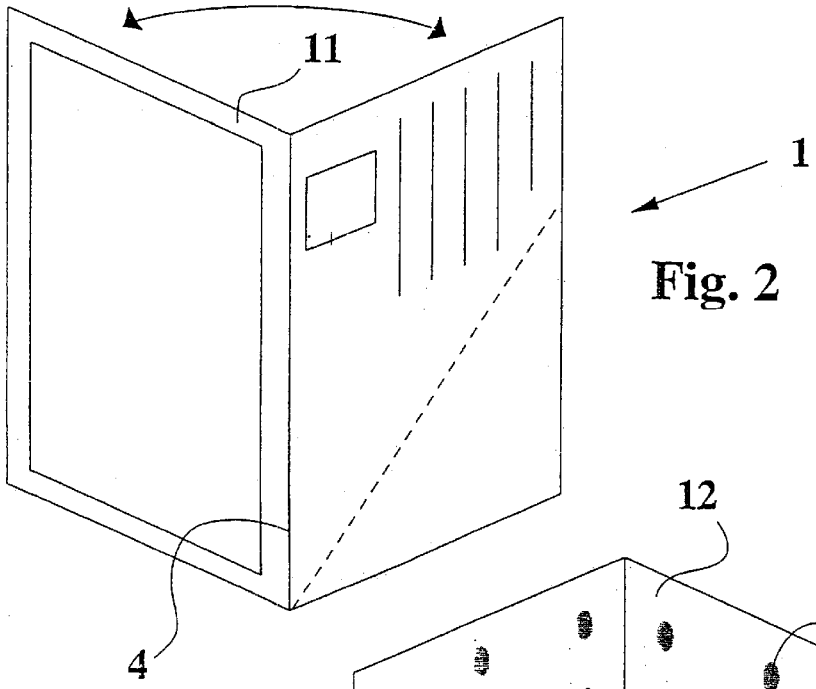
FIG. 2., shows always the stiff board as in FIG. 1., while it is being folded.
Figure 3:
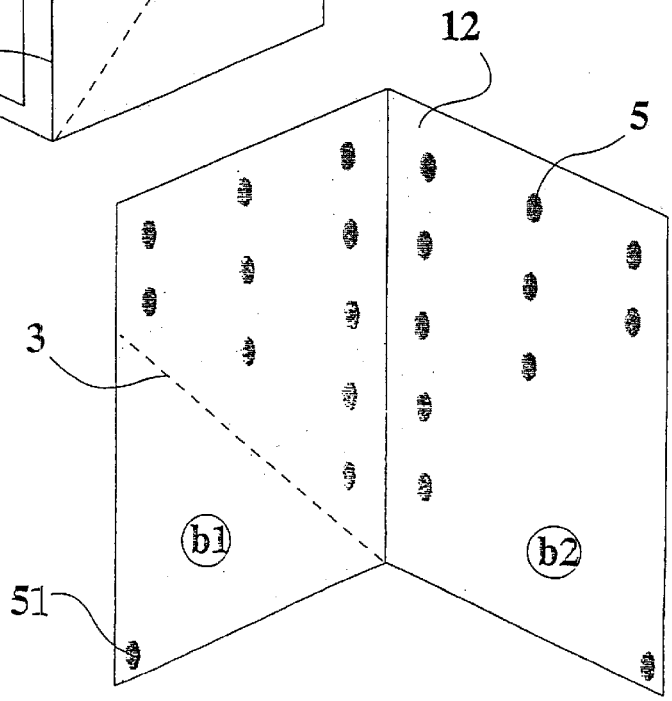
FIG. 3., shows the stiff board rear as in FIG. 2.
Figure 4:
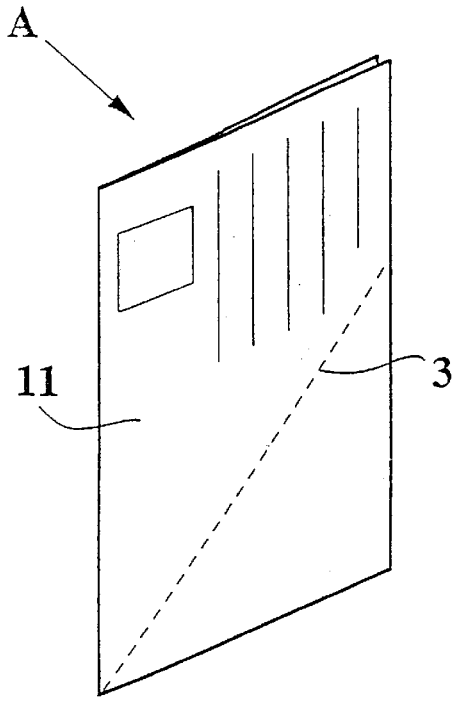
FIG. 4., shows in perspective, the stiff board as in the previous Figures completely folded, making up the postcard structure, ready to use.
Figure 5:
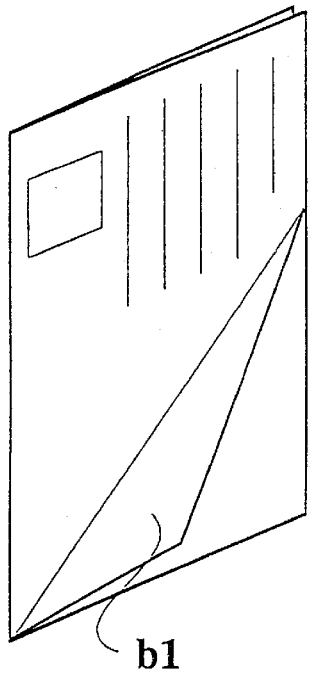
FIG. 5., shows always in perspective, the postcard structure as in FIG. 4., with an edge of the card layer folded as to form the support small foot.
Figure 6:
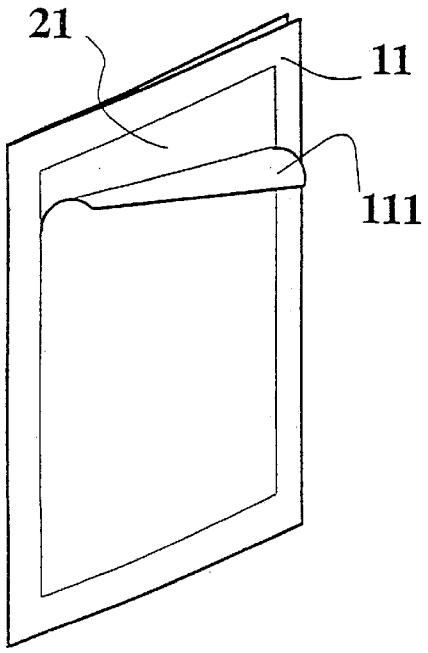
FIG. 6., shows in perspective the postcard structure front as in FIGS. 4. and 5., with a partially folded card edge for then being completely removed, uncovering the adhesive area destined to housing the photographic reproduction.
Figure 7:
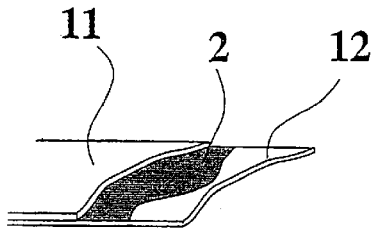

Finally, FIG. 7., shows a perspective view, of a portion of material by which the stiff board as in previous figures was obtained.

Figure 8:
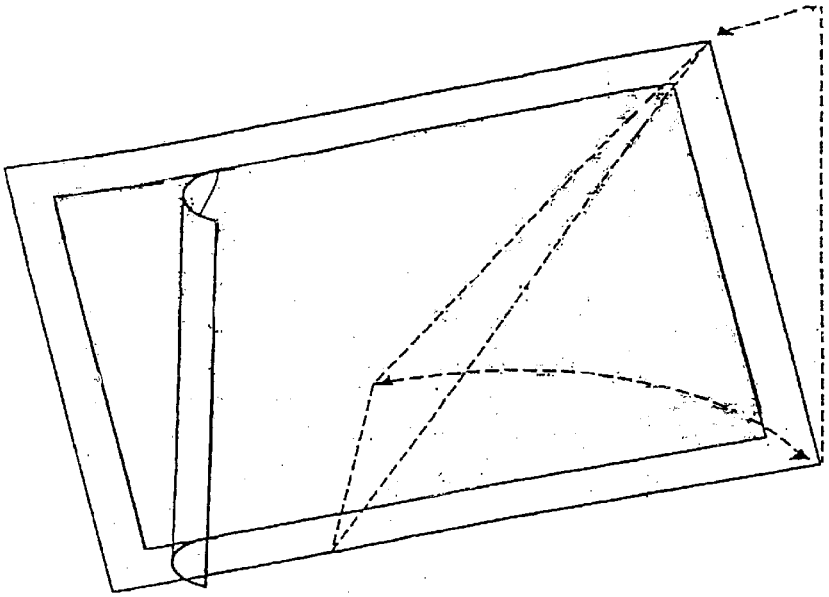
Figure 9:
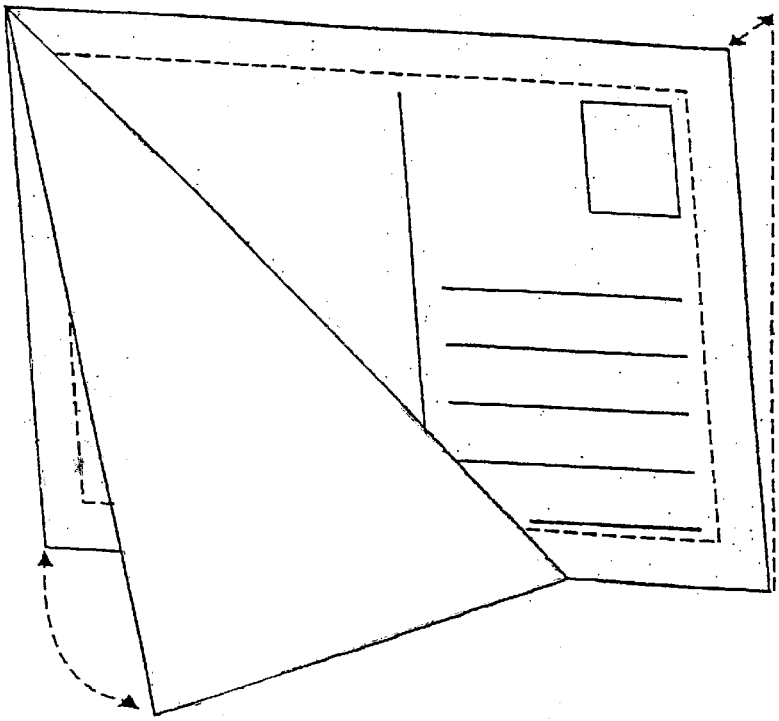
Figure 10:
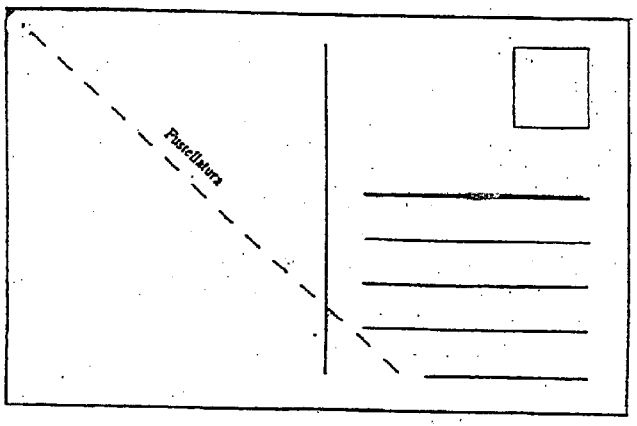

For what concerns the third table, it is enclosed as an example, and it is aimed at showing the pre-existing solution mentioned in the description, and more in detail, it concerns:

in FIG. 8., a photo-frame postcard front view, on which are highlighted the drawn dash-lines which define the backwards folded support means;

in FIG. 9., a view of the same structure rear as in FIG. 7., in which an edge of the card already lifted for becoming the support small foot is highlighted;

and in FIG. 10., a view, always of the postcard structure rear as in previous Figures, in which is shown an ideal pre-drawn dash-line, for allowing the folding of an edge as in FIG. 8., making up the resting small foot.

DETAILED DESCRIPTION

Also referring to the figures, it may be noticed that a photo-frame postcard structure (A), is essentially made up of a stiff board (1), suitably printed on one side or on both sides, and later folded in half, so to assume a preferably rectangular shape and with the following dimensions equal to about 17 cm. for the base and 12 cm. for the height.

Said stiff board (1), is obtained working on a semi-finished product, prearranged upstream, and made up of two cards (11, 12), previously jointed by the interposition of a bi-adhesive film (2). But the manufacturing of the stiff board (1) during the jointing step of said materials (11, 12) and (2), such as for instance it might occur in a continuous production process, must not be excluded.

For what concerns the shape of said stiff board (1), developed on plane, thus in an open condition, it is substantially rectangular. Even more in detail, it is provided that at least one side of the same stiff board (1), in this hypothesis the card visible side (11), is subdivided in two symmetrical areas, of which on the same side, a first one, in the case in point on the left (a1), aimed at supporting at least a photographic reproduction, and one on the right (a2) of the traditional type, for allowing the stamp affixing, for writing the addressee's name and the eventual greetings. In this case, the stiff board (1) area, defined as (a1) is concerned with a pre-cut line (6) which, being developed according to a rectangle, and concerning only the first card layer (11), allows, after the lifting, the local removal of a central part (111) of the card (11), leaving uncovered a corresponding adhesive area (21), obtained by the underlying presence of a total surface covering bi-adhesive film (2).

For what concerns part (a2), it, besides providing said pre-printed areas, has a folding line (3), which makes up a hinge for the lifting of a card edge, in this case (11), aimed at making up the support small foot (b1). This, appears as a diagonally drawn dash-line, and starts from a point of the stiff board (1) as the intersection point between said stiff board major side and the perpendicular axis (4), which divides the same in half. The opposite end of said folding line (3), being in diagonal, instead ends at a point, corresponding to about ⅔ of said stiff board mirror side (1), that is almost in correspondence of the area destined to the address writing.

With the purpose of retaining the two parts of the stiff board (1), thus folded on one another, during the working step, the local use of glue (5, 51) is provided. In the case in point, on the card visible surface, in this case (12) which makes up the inside of the postcard structure (A) being opposed to the card (11), some glue points (5) which mainly concern the top and the central part of the stiff board (1) are locally applied. More in detail, the glue spreading (5) keeping in consideration the dividing line in half (4) of the stiff board (1), concerns both side surfaces, specularly, keeping also into account the need of not interfering with the area gluing (b1, b2) one of whose parts corresponds to the resting small foot (b1) which, folded along the pre-drawn dash-line (3), allows to support the postcard almost standing and permanently. In such a way the side portions (b1, b2), limited on a side, by the folding line (3), on the other by the stiff board edge which provides at least one intersection angle between the major and the minor side, are only concerned by one glue point (51), located in the area which is closer to the corner. This condition, allows during the trading step and up to the time in which it has not yet reached the addressee, to keep always a flat surface, avoiding the accidental lifting of the edge (b1) of card (11, 12) which makes up said support small foot. Vice versa, once the postcard structure (A) has reached its destination, the user will only have to exert a slight force along the edge of the same, for detaching the small foot portion (b1) from the underlying part and thus allowing its folding as previously illustrated.

It will be understood that this invention is susceptible to modification in order to adapt it to different usages and conditions, and accordingly, it is desired to comprehend such modifications within this invention as may fall within the scope of the appended claims.

What is claimed is:

1. A photo-frame postcard comprising two superimposed layers of cardboard and a first adhesive area therebetween to define a flat member having a rectangular shape and front and rear surfaces, there being a first folding line at the mid-position of the flat member perpendicular to the longer side thereof to define first and second halves, a second adhesive area between the rear surfaces of said first and second halves to adhere said halves together when folded along said first fold line, a second folding line extending diagonally on the front surface of said second half from an end of said first folding line to a point substantially ⅔ of the distance along a shorter side of said flat member to define a support foot when folded outwardly, there being a pre-cut rectangular area on one of the layer on the front surface of said first half which can be removed to expose a portion of said first adhesive area to which a photograph in the attached.

2. A photo-frame postcard as claimed in claim 1 and there being a preprinted area for an address and stamp location on the portion of said front surface of said second half opposite said second folding line away from said support foot.

3. A photo-frame postcard as claimed in claim 1 wherein said second adhesive area comprises a plurality of spots outside of the area defined by said support foot.

4. A photo-frame postcard as claimed in claim 3 wherein said second adhesive area further comprises a single adhesive point in the area defined by said support foot.

* * * * *